US008252130B2

(12) United States Patent
Oguri et al.

(10) Patent No.: US 8,252,130 B2
(45) Date of Patent: Aug. 28, 2012

(54) SURFACE TREATMENT FOR TITANIUM ALLOY MEMBER FOR AEROSPACE EQUIPMENT

(75) Inventors: Kazuyuki Oguri, Nagoya (JP); Takashi Kimura, Nagoya (JP); Takahiro Sekigawa, Nagoya (JP); Takayuki Takahashi, Nagoya (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 758 days.

(21) Appl. No.: 11/795,405

(22) PCT Filed: Feb. 16, 2005

(86) PCT No.: PCT/JP2005/002346

§ 371 (c)(1),
(2), (4) Date: Jul. 17, 2007

(87) PCT Pub. No.: WO2006/087778

PCT Pub. Date: Aug. 24, 2006

(65) Prior Publication Data

US 2008/0138636 A1 Jun. 12, 2008

(51) Int. Cl.
*C22F 1/16* (2006.01)
*C22F 1/00* (2006.01)

(52) U.S. Cl. ..... 148/671; 148/222; 148/223; 148/421; 148/565; 148/668; 148/669; 148/670; 29/90.7

(58) Field of Classification Search ..... 72/53–54; 29/90.7; 148/565, 222–223, 668–671, 421
See application file for complete search history.

(56) References Cited

U.S. PATENT DOCUMENTS

| | | | | |
|---|---|---|---|---|
| 5,259,965 | A | 11/1993 | Kishi et al. | |
| 2002/0011267 | A1 * | 1/2002 | Hirose et al. | 137/375 |
| 2003/0000383 | A1 | 1/2003 | Ogihara et al. | |
| 2007/0134468 | A1 * | 6/2007 | Buehler | 428/141 |

FOREIGN PATENT DOCUMENTS

| | | |
|---|---|---|
| EP | 0 694 621 | 1/1996 |
| JP | 50-098451 | 8/1975 |
| JP | 52-016482 | 2/1977 |
| JP | 52-130429 | 11/1977 |
| JP | 04-131387 | 5/1992 |
| JP | 06-212393 | 8/1994 |
| JP | 06-256886 | * 9/1994 |

(Continued)

OTHER PUBLICATIONS

Japanese Official Information Document, Reasons of Submission submitted for Japanese Application No. 2003-297160 filed Aug. 21, 2003.

(Continued)

*Primary Examiner* — Lois Zheng
(74) *Attorney, Agent, or Firm* — Wenderoth, Lind & Ponack, L.L.P.

(57) ABSTRACT

Surface processing of titanium alloy members for aerospace equipment imparts high wear resistance, lubricity and high fatigue strength. The method includes an oxygen diffusion step for causing oxygen to diffuse and penetrate in solid solution form into a surface of a titanium alloy member under an oxygen-containing gas atmosphere and a particle bombardment step for bombarding the surface of the titanium alloy member with an airflow containing particles. The aerospace equipment can include a flap rail member and slat rail member for aircraft.

12 Claims, 6 Drawing Sheets

FOREIGN PATENT DOCUMENTS

| | | |
|---|---|---|
| JP | 11-029847 | 2/1999 |
| JP | 11-050227 | 2/1999 |
| JP | 2002-097914 | 4/2002 |
| JP | 2002-161371 | 6/2002 |
| JP | 2002-371348 | 12/2002 |
| JP | 2004-255522 | 9/2004 |
| JP | 2005-068470 | 3/2005 |
| WO | 99/04055 | 1/1999 |
| WO | 2004/007788 | 1/2004 |

OTHER PUBLICATIONS

Supplementary European Search Report mailed Mar. 19, 2009 in European Patent Application No. 05719198.3.

Japanese Office Action mailed Oct. 2, 2007 for Japanese Application No. 2003-297160 w/translation.

* cited by examiner (a) Phase diagram of O-Ti (b) Phase diagram of C-Ti

SURFACE TREATMENT FOR TITANIUM ALLOY MEMBER FOR AEROSPACE EQUIPMENT

TECHNICAL FIELD

The present invention relates to titanium alloy members for aerospace equipment having high wear resistance, lubricity and high fatigue strength. More specifically, the invention relates to titanium material members for aerospace equipment having better wear resistance and higher tensile fatigue strength than conventional materials.

BACKGROUND ART

A lot of sliding load members, such as the flaps and slats used during takeoff and landing, are employed in wings and the like of aircraft as illustrated in FIG. 5(*a*). They are required to have exceptionally high reliability in view of the fact that they are being used in an aircraft. Iron steel materials have conventionally been used as various wear resistant members, mainly because their inexpensive price and excellent workability enable manufacture of products with an intricate design at a low cost. In recent years, however, titanium has come to be used for sliding members to meet the needs for further reduction in weight. Owing to the excellent specific strength of titanium, the weight of members can be reduced. However, because they have an inferior wear resistance and sliding property, titanium members require an improvement of the wear resistance and sliding property by use of a surface coating such as Cr plating or WC—Co sprayed coating. In addition, plasma carburization has recently been developed (JP-A 2002-371348).

Although Cr-plated or WC—Co sprayed Ti materials have high wear resistance, they are inferior in fatigue strength to unprocessed Ti materials. Further, peeling of the coating inevitably occurs when a coating a substance is different from that of the base material is attached to the outer surface of the base material. On the other hand, plasma carburization has the problem that in spite of having an excellent sliding property as well as excellent wear resistance, it greatly reduces the fatigue strength of Ti materials.

Titanium materials are used as members for aircraft for which fatigue strength is needed. However, surface processing reduces their fatigue strength, which poses a serious problem. There is accordingly an eager demand for the development of a surface processing method for obtaining a titanium material having improved wear resistance and sliding property and moreover having improved fatigue strength.

SUMMARY OF THE INVENTION

In order to solve the above-described problems, the present inventors have carried out an intensive investigation in order to develop a titanium material for aerospace equipment having good wear resistance and high tensile fatigue strength.

As a result, it has been found that by subjecting the surface of a titanium material to an oxygen diffusion treatment and then high-speed shot peening processing with fine particles, the obtained titanium material has excellent wear resistance and is superior in tensile fatigue resistance to an unprocessed titanium member. The present invention has been completed from such a viewpoint.

In the present invention, there is thus provided a surface processing method of a titanium alloy member for aerospace equipment having high wear resistance, lubricity and high fatigue strength, which comprises an oxygen diffusion step of causing oxygen to diffuse and penetrate in solid solution form into a surface of a titanium alloy member under an oxygen-containing gas atmosphere; and a particle bombardment step of bombarding the surface of the titanium alloy member with an airflow containing particles.

In the oxygen diffusion step, low pressure plasma may be used. The particle bombardment step may be composed of at least two processing steps, more specifically, at least a first particle bombardment step using hard particles and a second particle bombardment step using particles having lubricity. The hard particles may be preferably made of ceramic, the particles having lubricity may preferably be metal sulfide particles or soft metal particles, or a mixture thereof. In the particle bombardment step, the surface of the titanium alloy member is typically bombarded with fine particles having a particle size of from 3 to 500 μm at an injection pressure (high speed) as high as from 0.2 to 1 MPa.

The titanium alloy thus processed by the above-described surface processing method can be used for various slide members used in aerospace equipment. Above all, it may be optimally used as an aircraft rail member such as a flap rail member or a slat rail member. Such a titanium alloy can also be suitably used in members around a door having many slide parts.

According to the processing method of the present invention, the combination of oxygen diffusion treatment and particle bombardment processing makes it possible to form a surface layer having high hardness and exhibiting a high compressive residual stress. The present method therefore makes it possible to obtain a titanium alloy member having both wear resistance and fatigue strength. The titanium member may further be given improved sliding property by applying a substance having lubricity to the bumps on its surface.

According to the present invention, a titanium member for aerospace equipment having wear resistance at least equal to that available by the conventional method (abrasion amount 1/200 of that of an unprocessed material) and exhibiting fatigue strength superior to that of the unprocessed material (10 times as much as that of the unprocessed material) can be provided.

BRIEF DESCRIPTION OF THE DRAWINGS

FIG. 4(*b*) is a phase diagram of carbon and titanium (C—Ti).

BRIEF DESCRIPTION OF THE REFERENCE NUMERALS

Figure 1:
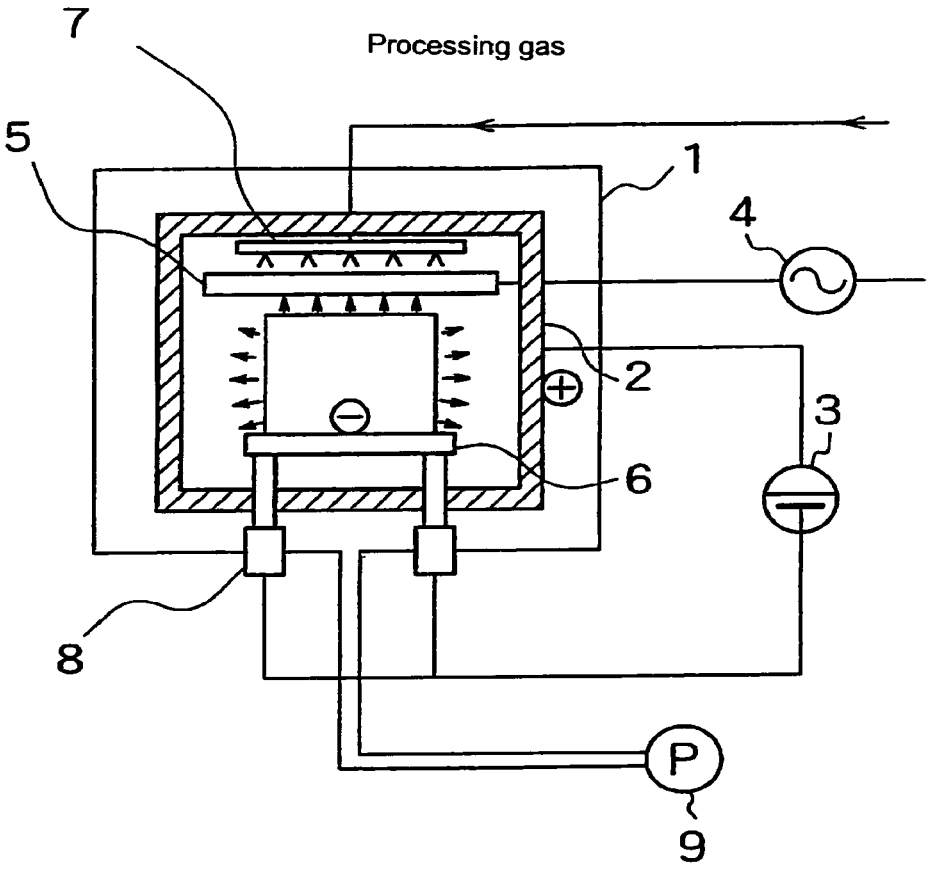
FIG. 1 illustrates an apparatus used for low pressure plasma processing which is one example of the oxygen diffusion step of the present invention.

In the drawings, reference numeral 1 denotes a vacuum furnace, reference numeral 2 denotes a heat insulator, reference numeral 3 denotes plasma, reference numeral 4 denotes a heating power supply, reference numeral 5 denotes a heater, reference numeral 6 denotes a hearth, reference numeral 7 denotes a gas manifold, reference numeral 8 denotes a negative electrode, reference numeral 9 denotes a vacuum pump, reference numeral 11 denotes a chamber, reference numeral 12 denotes a material to be processed, reference numeral 13 denotes a table, reference numeral 14 denotes a circulation line, reference numeral 15 denotes a nozzle, reference numeral 16 denotes a hopper, reference numerals 17 and 19 denote switch valves, and reference numeral 18 denotes an air line.

DETAILED DESCRIPTION OF THE INVENTION

The surface processing method of a titanium alloy member for aerospace equipment according to the present invention may comprise an oxygen diffusion step and a particle bombardment step.

The oxygen diffusion step may be a step of causing diffusion and penetration of oxygen, in the form of a solid solution, into the surface of the titanium alloy member in an oxygen-containing gas atmosphere. Specific examples of the oxygen diffusion step include a step of using low pressure plasma and a step of causing oxygen diffusion by heating.

Figure 4:
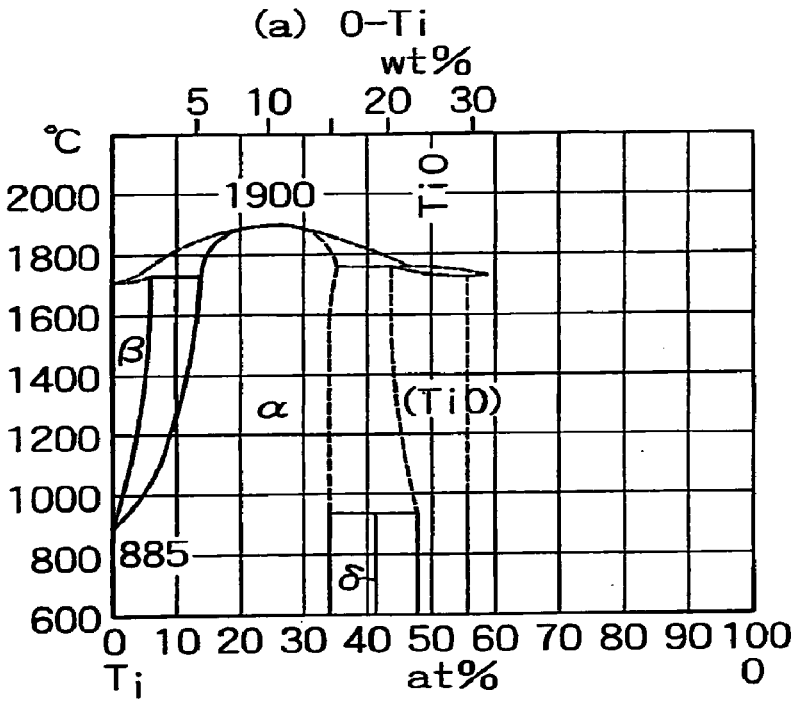
FIG. 4(*a*) is a phase diagram of oxygen and titanium (O—Ti).
Figure 4:
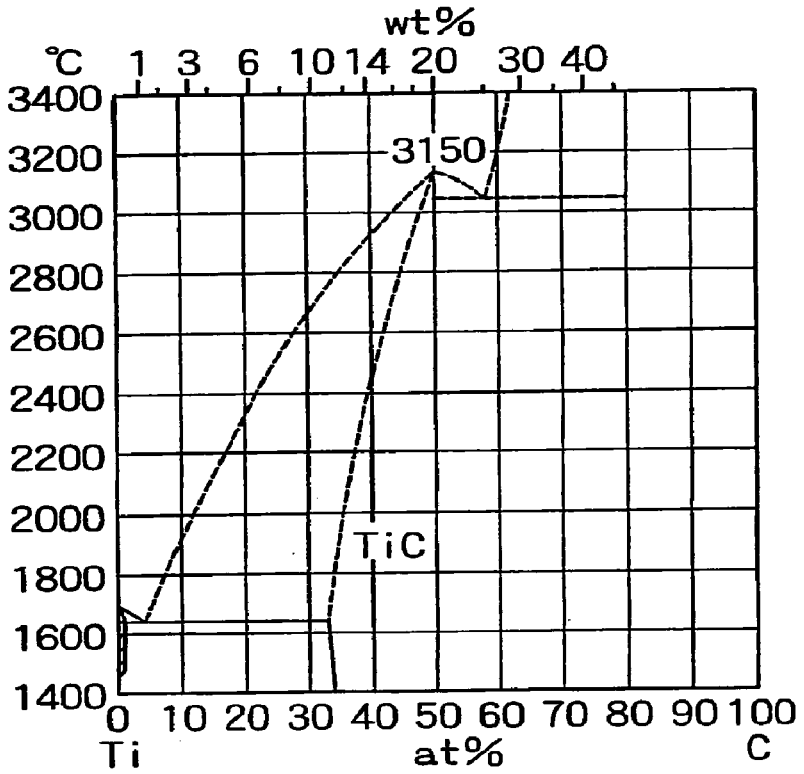

A phase diagram of oxygen and titanium (O—Ti) is shown in FIG. 4(*a*). As is apparent from the phase diagram, oxygen readily forms a solid solution in Ti. Most of the oxygen forms a solid solution when the amount of oxygen is 34% or less of that of Ti. By the oxygen diffusion step of the present invention, oxygen forms a solid solution in Ti and the solid solution thus formed is mainly an α-solid solution. Although the content of the oxygen is not limited, the amount of the oxygen relative to that of Ti may be typically 25% or less, preferably 15% or less. For reference, a phase diagram of carbon and titanium (C—Ti) is shown in FIG. 4(*b*). As is apparent from the phase diagram, only a small amount of carbon forms a solid solution in Ti and most of the carbon forms a compound of TiC. In other words, carbon forms only a thin TiC compound on the surface of a titanium base material in the carburization processing including plasma carburization.

The diffusion and penetration of oxygen into the surface of the titanium alloy member in the oxygen diffusion step may be performed to the depth of about 100 μm from the surface. The depth may be preferably about 50 μm. Even diffusion to the depth of, for example, about 10 μm is effective.

By the oxygen diffusion step as described above, the titanium alloy can have a surface excellent in not only wear abrasion resistance but also sliding property.

In the particle bombardment step subsequent to the oxygen diffusion step, the surface of the obtained titanium alloy member may be bombarded with an airflow containing particles. This step can greatly enhance the fatigue strength of the titanium alloy which has deteriorated as a consequence of the oxygen diffusion treatment. The obtained titanium alloy can be therefore superior in fatigue strength to a titanium alloy not subjected to oxygen diffusion treatment.

In the particle bombardment step of the present invention, fine particles having a particle size of typically from 3 to 500 μm, preferably from about 10 to 100 μm, are shot to the surface of a material to be processed at high speed. This results in improvement of fatigue strength, corrosion resistance and the like while causing less adverse effects on the surface properties such as surface roughness. Shot peening with ordinary particles of about 1 mm in size to the surface of a titanium alloy member subjected to the oxygen diffusion step tend to damage the surface layer, and is thus not preferred.

Figure 5:
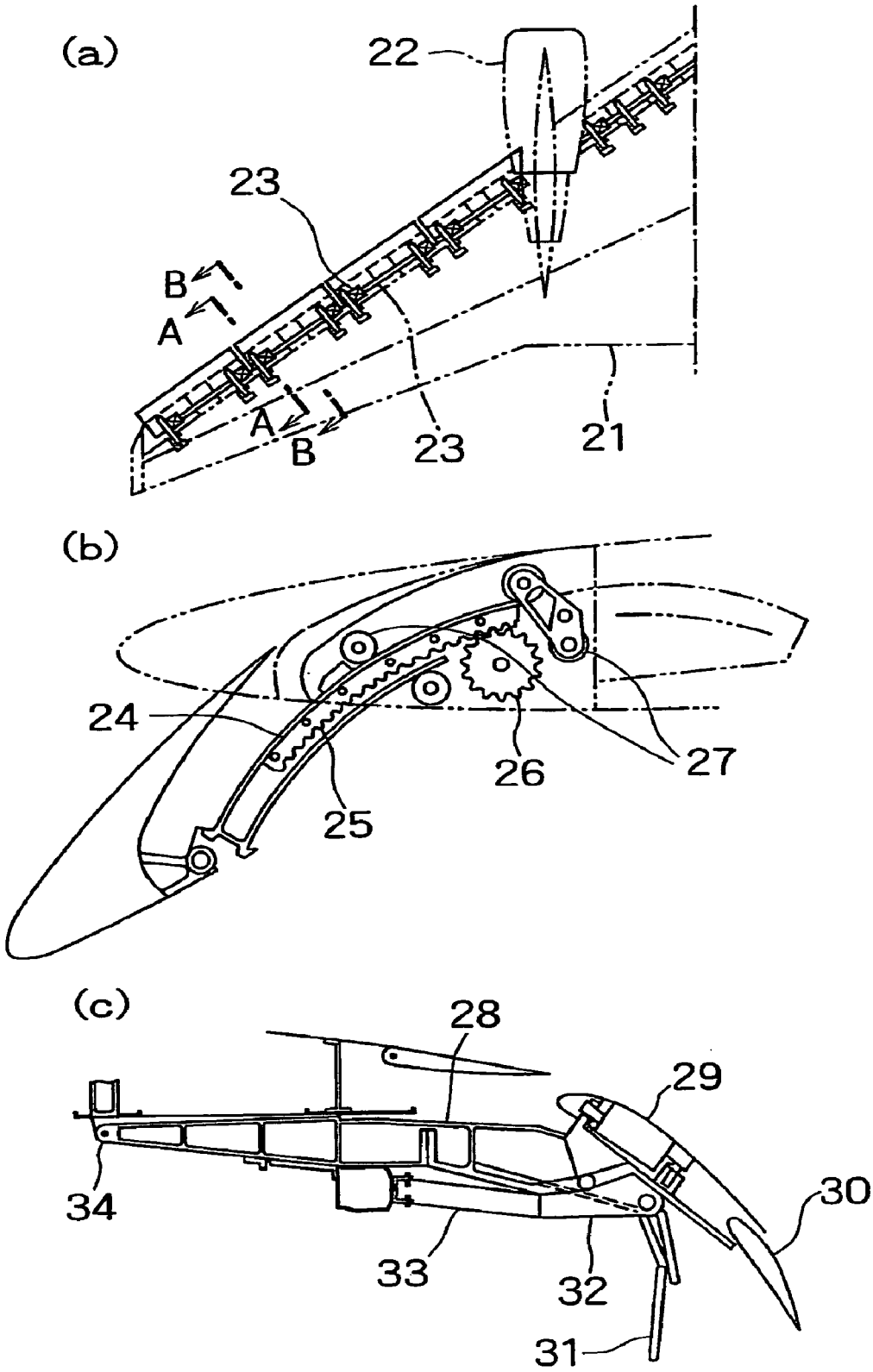
FIG. 5 is a structural drawing illustrating the structure of a wing of an aircraft, in which FIG. 5(*a*) is an overall view, FIG. 5(*b*) is a cross-sectional view taken along a line A-A and illustrating a leading edge slat mechanism of the wing illustrated in FIG. 5(*a*), and FIG. 5(*c*) is a cross-sectional view of a trailing edge flap mechanism.

A member obtained by the surface processing method of the present invention can be used preferably as a structural titanium material for aerospace equipment. More specifically, it can be used, for example, as a member constituting a flap rail or slat rail which is structurally important for aircraft. The slat (leading edge slat) is a mechanism for enhancing the lift of a main wing by forming a gap at the leading edge for changing the air flow. The flap (trailing edge flap) is a mechanism for enhancing the aerodynamic lift of the main wing by shifting the trailing edge and thereby increasing the area of the wing. The slat rail or flap rail is one of principal mechanisms for moving the slat or flap. It has a mechanism of moving the slat or flap from side to side or up and down by the rotation and transfer of a roller on the rail (track). For example, in the wing 21 of the aircraft illustrated in FIG. 5(*a*), FIG. 5(*b*) is a cross-sectional view showing the mechanism of the leading edge slat. FIG. 5(*c*) is a cross-sectional view showing the trailing edge flap mechanism. In the diagram (b), reference numeral 24 denotes a feeding track (rail). In the diagram (c) reference numeral 28 denotes a track (rail) of a main flap. Reference numeral 22 denotes an engine, reference numeral 23 denotes an angle regulator track, reference numeral 25 denotes a sector gear, reference numeral 26 denotes a feeding pinion, reference numeral 27 denotes a supporting member, reference numeral 29 denotes a main flap, reference numeral 30 denotes a sub flap, reference numeral 31 denotes a track rail cover actuating link, reference numeral 32 denotes a main flap carriage, reference numeral 33 denotes a screw jack for actuation and reference numeral 34 denotes a track (rail) attachment bracket.

The present invention will hereinafter be described more specifically by some embodiments. It should however be borne in mind that the present invention is not limited by these embodiments.

Embodiment (1)

In this embodiment, processing with low pressure plasma may be performed in an oxygen-containing gas atmosphere as an oxygen diffusion step. A material such as titanium alloy which is to be processed may be typically subjected to pretreatment.

Specific examples of a titanium alloy for aerospace equipment which is to be processed include pure titanium, α+β titanium alloys such as Ti—6Al—4V, Ti—8Mn, Ti—6Al—6V—2Sn, and Ti10V—2Fe—3Al, α titanium alloys such as Ti—5Al—2.5Sn, and β titanium alloys such as Ti—13V—11Cr—3Al, Ti—15Mo—5Zr—3Al, and Ti—15V—3Cr—3Al—3Sn. The heat treatment of the titanium material which is to be performed as a pretreatment may include, but is not particularly limited to, annealing, a solution treatment, and an aging treatment and the like. As a cleaning treatment, any cleaning methods commonly used prior to a vacuum treatment are sufficient. For example, ultrasonic cleaning with an organic solvent can be employed.

An apparatus using low pressure plasma is schematically illustrated in FIG. 1.

Inside of a vacuum furnace 1, a hearth 6 leading to a negative electrode is disposed inside of a space covered with a heat insulator 2. A material to be processed is placed on the hearth. Inside of the heat insulator 2, a heater 5 and a gas manifold 7 for feeding a processing gas are disposed at the upper portion. The vacuum furnace 1 is connected to a vacuum pump 9 disposed outside. The heater 5 is connected to a heating power supply 4. The heat insulator 2 and the vacuum furnace 1 act as a positive electrode (ground electrode) and are connected to the negative electrode 8 via a plasma power supply 3.

A member to be processed is placed on the hearth 6 in the vacuum furnace 1 and heating with the heater 5 may be started after vacuuming. Water and gases such as oxygen and nitrogen adsorbed to the interior of the furnace 1 (furnace wall, member and the like) are desorbed and the resulting oxygen-containing gas reduces the degree of vacuum and causes a slight increase in the pressure. This makes it possible to appropriately adjust the amount of oxygen present in the furnace 1. As a result of the low pressure plasma processing, an adequate amount of oxygen can be made to diffuse and penetrate into the titanium member. The oxygen partial pressure in the vacuum furnace 1 can be measured using a mass spectrometer or the like.

When the apparatus used for the processing is a vacuum furnace which is evacuated to achieve a very high degree of vacuum or when the amount of the titanium member inserted in the apparatus is large, the amount, per unit surface area, of oxygen diffused and penetrated into the titanium member which requires surface processing decreases. This may cause insufficient diffusion and penetration of oxygen into the titanium member. In such cases, air can be forced into the furnace during heating to supply it with an adequate amount of oxygen, thereby causing diffusion and penetration of oxygen. More specifically, the low pressure plasma processing can be carried out by introducing air into the furnace as easy and inexpensive means and maintaining the pressure at 0.1 to 1 Torr for about 5 to 60 minutes.

Low-pressure plasma processing may be performed typically for about 0.5 to 10 hours, preferably for about 1 to 5 hours by using, for example, a carbon-containing gas as a processing gas and generating plasma in an atmosphere containing C (carbon). Examples of a gas for diffusion treatment include CO, $CO_2$ and propane gas. Air may also be usable as needed. The pressure may be adjusted typically within a range of from 10 to 1000 Pa and the temperature may be adjusted typically within a range of from 300 to 1000° C. Oxygen adsorbed to the surface by heating and ionized oxygen by glow discharge may collide with, be adsorbed to and diffuse into the surface of the titanium alloy to be processed.

The low-pressure plasma processing promotes diffusion and penetration, into a further deeper portion, of oxygen concentrated at the outermost surface, whereby the titanium alloy can have a composition showing a continuous oxygen concentration distribution. By the oxygen diffusion treatment, oxygen is diffused and penetrated into the titanium alloy to form a solid solution. Formation of a TiC layer and formation of a carbon film due to free carbon may sometimes occur slightly on the outermost surface.

In the particle bombardment step, the surface of the titanium alloy member may be bombarded with an airflow containing particles.

Figure 2:
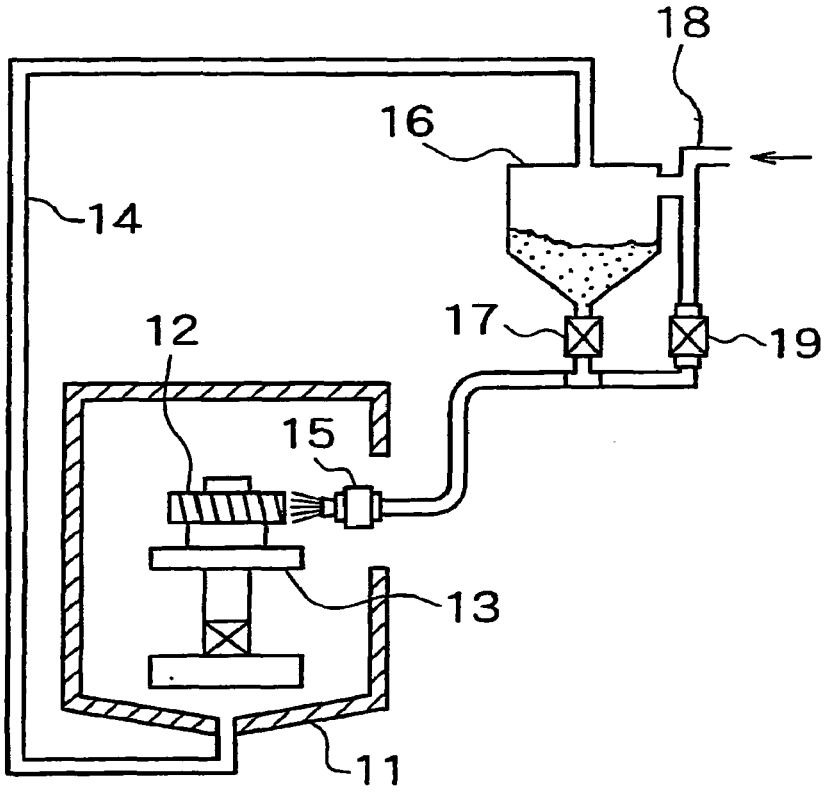
FIG. 2 illustrates one example of an apparatus for fine-particle shot peening in the particle bombardment step of the present invention.

A schematic view of an apparatus for fine particle shot peening is shown in FIG. 2. A chamber 11 is equipped with a turning table 13 for placing thereon a material to be processed 12. On the side surface of the chamber, an air nozzle 15 for injecting fine particles toward the member 12 is disposed. The fine particles are filled in a hopper 16, which is connected, at the lower portion thereof, to an air line 18 via a switch valve 17. High pressure air is introduced through this air line 18 via an air switch valve 19, whereby the fine particles and air are fed together to the air nozzle 15 under pressure. A circulation line 14 having an opening at the bottom portion of the chamber 11 is typically connected to the upper portion of the hopper 16, whereby the fine particles can be collected for reuse.

In this embodiment, the particle bombardment step may comprise a first particle bombardment step using hard particles and a second particle bombardment step using particles having lubricity. The first particle bombardment step using hard particles is an indispensable step, but the second particle bombardment step may be performed arbitrarily in order to reduce the friction coefficient of the surface of the material to be processed.

In the first particle bombardment processing, particle materials such as iron particles are not used in order to retain good corrosion resistance of titanium. Ceramic particles and glass particles, for example, may be desirably employed. More specifically, $Al_2O_3$—$SiO_2$ and the like particles are preferred. The particle size is typically from 3 to 500 μm, preferably from 10 to 100 μm, and especially preferably from 20 to 80 μm. The bombardment speed of the particles, which is indicated by pressure, is typically from about 0.2 to 1 MPa (high-speed bombardment corresponding to a jet velocity of from about 150 to 400 m/s when the particles have a diameter of about 50 μm) and the bombardment time varies, depending on the processed area. The bombardment with the particles may be carried out to basically attain full coverage. When iron particles are used in the first particle bombardment step, it may be preferable to chemically remove the iron content adhered to the surface by a suitable solution. Removal of the iron content maintains the corrosion resistance of titanium. After that, the method of the present invention may be applied.

In the second particle bombardment processing, metal sulfide particles or soft metal particles, or a mixture thereof, for example, fine particles obtained by mixing Sn particles and $MoS_2$ particles can be used as the particles having lubricity in view of reducing the friction coefficient of the surface. $MoS_2$ particles can be mixed with Sn preferably in an amount of from about 10 to 30 vol. %. The particle size is typically in the range of 3 to 500 μm. Any size of particles within the range can be used in combination. When a mixture of particles is employed, it is preferred that Sn particles have a particle size of from about 100 to 300 μm and $MoS_2$ particles have a particle size of from about 3 to 5 μm. The bombardment speed of particles can be indicated by pressure and is typically from about 0.2 to 1 MPa (high-speed bombardment corresponding to a jet velocity of from about 80 to 250 m/s when particles having a diameter of about 200 μm are used). The bombardment time may vary, depending on the area of the material to be processed. The particles may be projected basically to attain full coverage of the material.

Embodiment (2)

In this embodiment, oxygen diffusion treatment by heating under an oxygen-containing gas atmosphere is performed as the oxygen diffusion step. A material such as titanium alloy to be processed is typically subjected to pretreatment.

Oxidation treatment by heating of titanium or titanium alloy is a convenient method. The method may need only heating in an ordinarily used furnace in an air atmosphere. A thicker solid solution layer of oxygen can be formed at a low temperature compared with that formed by nitriding treatment or the like. An oxide layer (TiO) formed simultaneously during the oxidation treatment comes off easily. Thus, the treatment has to be performed so as not to form an oxide layer. In this embodiment, a solid solution layer of oxygen can be formed without forming an oxide by heating of titanium or titanium alloy to 400 to 900° C. in an atmosphere controlled to an oxygen partial pressure of 1 Torr or less and $10^{-4}$ Torr or greater. Since water acts similarly to oxygen, a water partial pressure can be added to an oxygen partial pressure. Nitrogen, if any, may have less influence on the formation of a solid solution layer of oxygen. This also applies to an inert gas such as Ar or helium.

In the particle bombardment step subsequent to the oxygen diffusion step, the surface of the titanium alloy member may be bombarded with an airflow containing particles similar to Embodiment (1). Fine particle shot peening can be performed using the apparatus illustrated in FIG. 2. As in the case of Embodiment (1), the particle bombardment step may have a first particle bombardment step using hard particles and a second particle bombardment step using particles having lubricity.

The present invention will hereinafter be described more specifically by working examples. It should however be borne in mind that the invention is not limited to or by these Examples.

Example 1

The Example demonstrates an alloy subjected to the processing according to Embodiment (1). The base material had an alloy composition of Ti—6Al—4V.

As the pretreatment, the surface of the titanium alloy was cleaned by ultrasonic cleaning with an organic solvent. Oxygen diffusion treatment was then performed using the low pressure plasma apparatus illustrated in FIG. 1. Although oxygen was not deliberately introduced into the apparatus during the treatment, oxygen was present in the vacuum furnace at an oxygen partial pressure of about 0.2 Torr during temperature-raising heating treatment after the pressure reduction by a vacuum exhaust apparatus. After heating at 850° C. and keeping the temperature for 30 minutes, 1 Torr of a propane gas was introduced. Plasma processing was performed for 2 hours while heating to keep the temperature at 850° C.

Next, as the first particle bombardment processing, fine particle shot peening with $Al_2O_3$—$SiO_2$ particles having a particle size of 50 μm was performed for about 1 second toward a substantially equal position at a bombardment speed, in terms of pressure, of 0.45 MPa. As the second particle bombardment processing, that is, a final step, the surface of the titanium alloy was bombarded with a mixture of Sn particles with 20 vol. % of $MoS_2$ particles at a bombardment pressure of 0.45 MPa.

The composition of the resulting titanium alloy from the surface to a certain depth was measured using an EPMA analyzer (product of JEOL Ltd.) in order to analyze the composition near the surface of the alloy.

Figure 3:
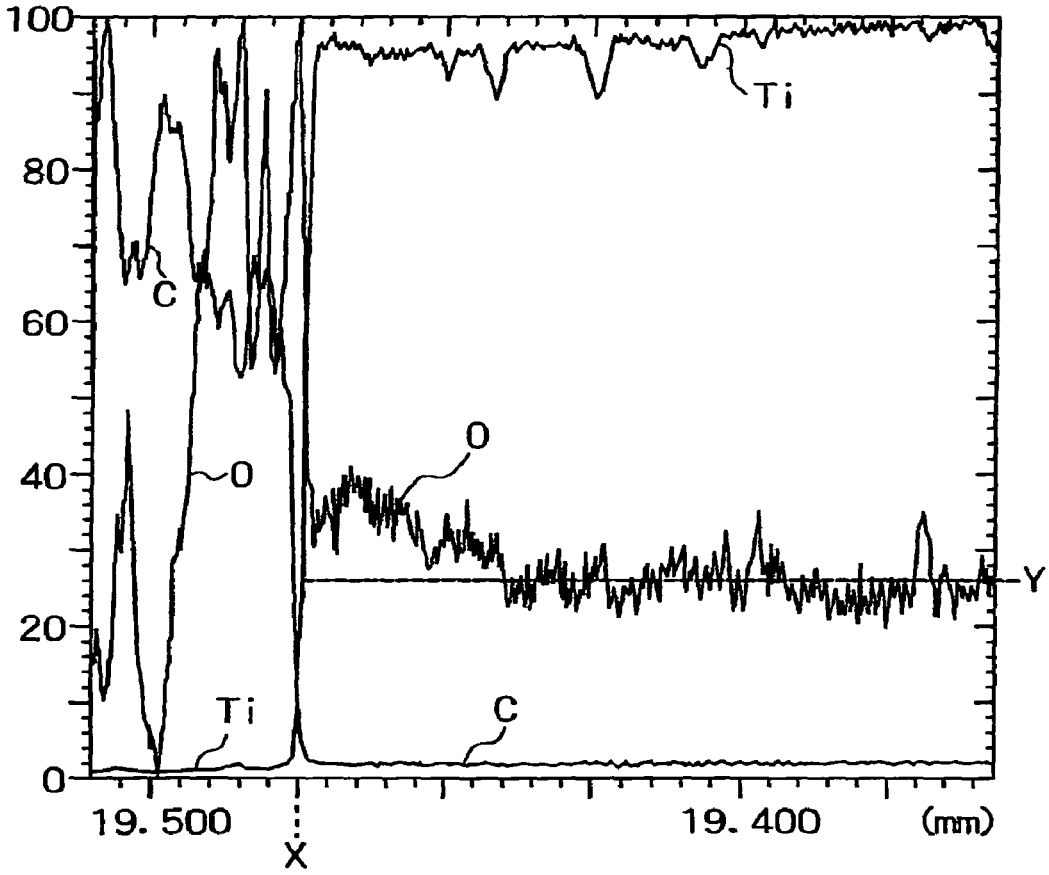
FIG. 3 is a chart showing a measured result of the composition near the surface of a titanium alloy subjected to the processing of the present invention in Example 1.

The results are shown in FIG. 3. X represents the outermost surface of the titanium alloy and Y represents the base line of oxygen (O). It was confirmed that relative to Ti, no carbon (C) was present in the composition at the deep position of the alloy shown on the right side of a point X in the graph, but oxygen (O) diffused and penetrated into the depth of from about 30 to 40 μm.

A wear resistance evaluation test was carried out on the titanium alloy material subjected to the above-described processing of the present invention. The test employed was ASTM D2714 Falex block-on-ring friction and wear test. In the test, a load (15 lb) is applied to a surface-treated block to press it against a steel ring that is rotated without lubrication. The wear resistance of the block is evaluated by the width and depth of a region that has been worn. A similar test was carried out on the conventional Ti—6Al—4V annealed material, rigid CR plated material and WC—Co sprayed material.

As a result, the Ti—6Al—4V annealed material had a wear width of 5 mm and wear depth of 210 μm, the rigid Cr plated material had a wear width of 1 mm and wear depth of 8 μm, and the WC—Co sprayed material had a wear width of 0.9 mm and wear depth of 7 μm, while the titanium alloy material subjected to the processing of the present invention had a wear width of 1 mm and wear depth of 6 μm. These results have revealed that the material subjected to the processing of the present invention had wear resistance at least equal to that of the materials subjected to conventional processing.

Next, the Ti—6Al—4V annealed material subjected to the processing of the present invention was evaluated for tensile fatigue strength. The test was carried out using an unnotched flat bar material having, at an evaluated part thereof, a diameter of 6.35 mm at a stress ratio of 0.1 and speed of 10 Hz. As a comparative example, a similar test was made on an unprocessed titanium alloy material and a material subjected to only fine particle shot.

Figure 6:
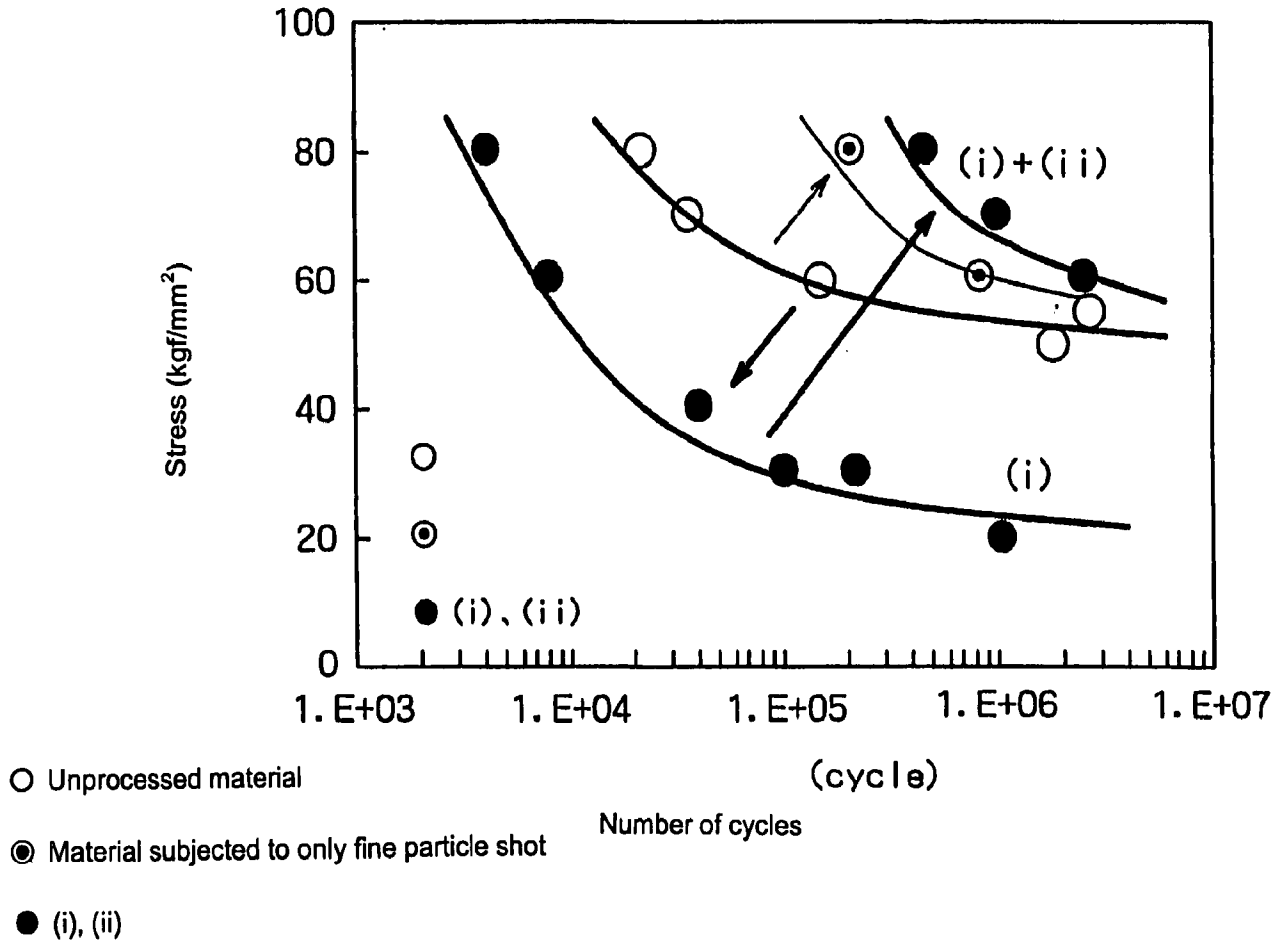
FIG. 6 is a graph showing the measurement results of fatigue strength in Example 1.

The results are shown in FIG. 6. It was confirmed from the results of the unprocessed material and member subjected to only fine particle shot peening that the fine particle shot peening was effective for improving the fatigue strength. When the titanium alloy material was subjected to the processing of the present invention, oxygen diffusion treatment (i) by low pressure plasma caused a temporary reduction in fatigue strength. Marked recovery of the fatigue strength however was observed by applying the particle bombardment processing (ii) with fine particles to the member subjected to the step (i). For example, when a tensile strength applied to the materials was 60 kgf/mm$^2$, the unprocessed material was broken at the number of cycles of $1.4\times10^5$, while the processed material according to the present invention was not broken even at the number of cycles of about $2.2\times10^6$. The life of the processed material was thus longer by at least 10 times that of the unprocessed material. As is also apparent from the results of FIG. 6, it can be seen that the unprocessed material subjected to the combination of the step (i) and step (ii) was superior in fatigue strength to the unprocessed material subjected to fine particle shot.

The member obtained by the surface processing method of the present invention is suited for a structural titanium material for aerospace equipment. More specifically, it is usable, for example, as a member constituting a flap rail or slat rail which is a structurally important member of an aircraft.

The invention claimed is:

1. A surface processing method for a titanium alloy member for aerospace equipment having high wear resistance, lubricity and high fatigue strength, said method consisting of:

an oxygen diffusion operation using low pressure plasma processing which causes oxygen to diffuse and penetrate in solid solution form into a surface of a titanium alloy member under an oxygen-containing gas atmosphere by heating the titanium alloy member to a temperature of 400 to 900° C. at a pressure of $10^{-4}$ to 1 Torr; and at least one shot peening operation of bombarding the surface of the titanium alloy member with an airflow containing fine particles at an injection pressure of 0.2 to 1 MPa, the fine particles having a particle size of 3 to 500 μm.

2. The surface processing method of claim 1, wherein the at least one shot peening operation comprises at least two processing operations.

3. The surface processing method of claim 2, wherein the at least two processing operations comprises a first shot peening operation using hard particles and a second shot peening operation using particles having lubricity.

4. The surface processing method of claim 3, wherein the hard particles comprise ceramic particles, and the particles having lubricity are particles selected from the group consisting of metal sulfide particles, soft metal particles, and a mixture of metal sulfide particles and soft metal particles.

5. The surface processing method of claim 1, wherein oxygen is diffused into the titanium alloy member to a depth of about 30 to 40 μm.

6. The surface processing method of claim 1, wherein the particle size of the fine particles is 10 to 100 μm.

7. The surface processing method of claim 1, wherein the particle size of the fine particles is 20 to 80 μm.

8. The surface processing method of claim 1, wherein the low pressure plasma processing is carried out by maintaining the pressure at 0.1 to 1 Torr.

9. A surface processing method for a titanium alloy member for aerospace equipment having high wear resistance, lubricity and high fatigue strength, said method comprising:

an oxygen diffusion operation using low pressure plasma processing which causes oxygen to diffuse and penetrate in solid solution form into a surface of a titanium alloy member under an oxygen-containing gas atmosphere by heating the titanium alloy member to a temperature of 400 to 900° C. at a pressure of $10^{-4}$ to 1 Torr;

a first shot peening operation of bombarding the surface of the titanium alloy member with an airflow containing hard particles at an injection pressure of 0.2 to 1 MPa, the hard particles having a particle size of 3 to 500 μm; and a second shot peening operation of bombarding the surface of the titanium alloy member with an airflow containing fine particles at an injection pressure of 0.2 to 1 MPa, the fine particles having a particle size of 3 to 500 μm, wherein the fine particles of the second shot peening operation have lubricity, and wherein oxygen is diffused into the titanium alloy member to a depth of about 30 to 40 μm.

10. The surface processing method of claim 9, wherein the particle size of the particles in both the first shot peening operation and the second shot peening operation is 10 to 100 μm.

11. The surface processing method of claim 9, wherein the particle size of the particles in both the first shot peening operation and the second shot peening operation is 20 to 80 μm.

12. The surface processing method of claim 9, wherein the low pressure plasma processing is carried out by maintaining the pressure at 0.1 to 1 Torr.

* * * * *